US008591138B2

(12) United States Patent
Royer et al.

(10) Patent No.: US 8,591,138 B2
(45) Date of Patent: Nov. 26, 2013

(54) FASTENER FOR STREET IRONWORK, ASSEMBLY, STREET IRONWORK AND CORRESPONDING METHOD

(75) Inventors: Jean-Claude Royer, Lesmenils (FR); Vincent Rotharmel, Vandieres (FR)

(73) Assignee: Saint-Gobain Pam, Nancy (FR)

( * ) Notice: Subject to any disclaimer, the term of this patent is extended or adjusted under 35 U.S.C. 154(b) by 0 days.

(21) Appl. No.: 13/496,205

(22) PCT Filed: Sep. 3, 2010

(86) PCT No.: PCT/FR2010/051834

§ 371 (c)(1), (2), (4) Date: May 7, 2012

(87) PCT Pub. No.: WO2011/033205

PCT Pub. Date: Mar. 24, 2011

(65) Prior Publication Data

US 2012/0213581 A1 Aug. 23, 2012

(30) Foreign Application Priority Data

Sep. 16, 2009 (FR) ..... 09 56358

(51) Int. Cl.
*E02D 29/14* (2006.01)

(52) U.S. Cl.
USPC ..... 404/25

(58) Field of Classification Search
USPC ..... 404/25; 137/371; 52/19; 70/158
See application file for complete search history.

(56) References Cited

U.S. PATENT DOCUMENTS

| | | | | |
|---|---|---|---|---|
| 3,920,347 | A * | 11/1975 | Sauriol et al. | 404/25 |
| 3,921,494 | A * | 11/1975 | Coe | 411/344 |
| 4,080,984 | A * | 3/1978 | Klein | 137/371 |
| 4,364,689 | A * | 12/1982 | Dumortier | 404/25 |
| 5,950,368 | A | 9/1999 | Bradford | |
| 6,550,294 | B2 * | 4/2003 | Garguilo | 70/168 |
| 6,588,810 | B1 | 7/2003 | Monneret | |
| 6,951,318 | B1 | 10/2005 | Petersen et al. | |
| 7,243,515 | B2 * | 7/2007 | Meyer | 70/269 |
| 7,484,909 | B2 * | 2/2009 | Brady et al. | 404/25 |
| 2004/0244444 | A1 | 12/2004 | Wadsworth | |
| 2012/0020728 | A1 * | 1/2012 | Royer et al. | 404/25 |
| 2012/0020729 | A1 * | 1/2012 | Royer et al. | 404/25 |

FOREIGN PATENT DOCUMENTS

| | | | |
|---|---|---|---|
| DE | 295 00 086 | U1 | 3/1995 |
| FR | 2 780 996 | A1 | 1/2000 |
| WO | 2008/025029 | A2 | 2/2008 |

OTHER PUBLICATIONS

International Search Report, dated Mar. 17, 2011, from corresponding PCT application.

* cited by examiner

*Primary Examiner* — Gary Hartmann
(74) *Attorney, Agent, or Firm* — Young & Thompson

(57) ABSTRACT

The present fastener (36) for street ironwork includes a fastening or locking element (56). The fastener (36) includes a retaining foot (60) suitable for removably connecting the fastener (36) to a member of the street ironwork, via a receiving cavity (40) made in the member of the street ironwork by element of a shape-matching connection. The invention further relates to the use in attaching jacks to man hole covers.

21 Claims, 15 Drawing Sheets

FASTENER FOR STREET IRONWORK, ASSEMBLY, STREET IRONWORK AND CORRESPONDING METHOD

The present invention relates to a fastener for a street ironwork comprising a fastening or locking means.

Fasteners of this type are known used to fasten an accessory on a device for closing a technical inspection room of an underground cabled network, such as an access hatch for telecommunications facilities, or a manhole or inspection hole closing device for an underground water system, such as a manhole in a road or sidewalk.

These street ironwork devices generally comprise a frame durably sealed in the ground, in which one or more covers are releasably inserted, positioned even with the surface of the ground.

The drawback of such fasteners lies in the fact that they are made specially for the cover and are therefore expensive.

Furthermore, with such complex fasteners, the assembly of the accessory on the street ironwork is often delicate or even dangerous, and requires a skilled laborer.

The invention aims to propose a simple and economical fastener that facilitates the assembly of an accessory on a street ironwork.

To that end, the invention relates to a fastener as indicated above, including a retaining foot suitable for removably connecting the fastener to a member of the street ironwork via a receiving cavity made in the member of the street ironwork by means of a shape-matching connection.

The fastener according to the invention can comprise one or more of the following features:

- The retaining foot includes at least one fastening arm, preferably two arms, adapted to cooperate by shape-matching connection with the member of the street ironwork, the fastening between the fastener and the member of the street ironwork preferably being of the bayonet type.
- The fastener includes a punch adapted to form the receiving cavity in the member of the street ironwork, the punch preferably being formed by the retaining foot.
- The fastener is made in a single piece.
- The fastener is substantially in the shape of an L with two wings, the retaining foot being fastened on one of the wings, the fastening means being positioned on the other of the wings.
- The fastener is made from metal, in particular cast iron.

The invention also relates to an assembly made from a street ironwork member, in particular a frame or a cover, and a fastener, the fastener is a fastener as defined above, and the assembly defines a retaining configuration in which the fastener is engaged in the receiving cavity and retained therein and a released configuration in which the fastener can be removed from the receiving cavity.

The assembly according to the invention can include one or more of the following features:

- In the retaining configuration, the fastener is adapted to oscillate relative to the member of the street ironwork between two stop positions.
- The fastener comprises a fastening base secured to the retaining foot and extending substantially perpendicular relative to the retaining foot, the base having two opposite stops each adapted to come into contact with the member of the street ironwork in one of the stop positions.
- The fastener has an oscillating freedom between the two stop positions comprised substantially between 5° and 15°.

- In the retaining configuration, the fastener is fastened to the member of the street ironwork without a possibility of oscillation.
- The member of the street ironwork includes a removable covering portion, covering the receiving cavity, and fastened by at least one frangible portion to the member of the street ironwork.
- The fastener is a fastener as defined above, and the punch includes a striking surface whereof the shape is substantially identical to the shape of the covering portion.
- The covering portion and the frangible portion are made in a single piece with the member of the street ironwork.
- The fastening or locking means is a retaining projection adapted to abut against another element of the street ironwork, in particular a frame.
- The assembly comprises a stop means adapted to prevent movement of the fastener outside its retaining configuration.
- The stop means comprises a pin.

The invention also relates to a street ironwork, in particular an access cover, comprising a frame defining an access opening, characterized in that it comprises an assembly as defined above, the member of the street ironwork being a cover adapted to cover the access opening.

The street ironwork according to the invention can include one or more of the following features:

- It also comprises a thrust member, in particular a jack to assist in lifting the cover, the thrust member being adapted to be fastened by one of its ends to the frame, the fastener being connected to the cover using the cavity and the thrust member being fastened by its other end to the fastening means.
- The cover defines a release position relative to the frame in which the thrust member is in a released configuration, in particular the release position is situated between a position 90° open and a maximum opening position of the cover relative to the frame.

The invention also relates to a method for fastening an accessory on a street ironwork using a fastener or using an assembly, comprising the following steps:

- placing the retaining foot on the member of the street ironwork;
- pushing the retaining foot in using a tool on the member of the street ironwork so as to form the receiving cavity;
- inserting the retaining foot through the cavity and rotating the retaining foot so as to retain the fastener on the member of the street ironwork; and
- fastening the accessory using the fastening means.

The invention will be better understood upon reading the following description, provided solely as an example and done in reference to the appended drawings, in which:

FIGS. 1 and 2 show an access cover according to the invention, which is designated by general reference 10 and which is for example an access cover to an underground technical room containing telecommunications equipment.

Figure 1:
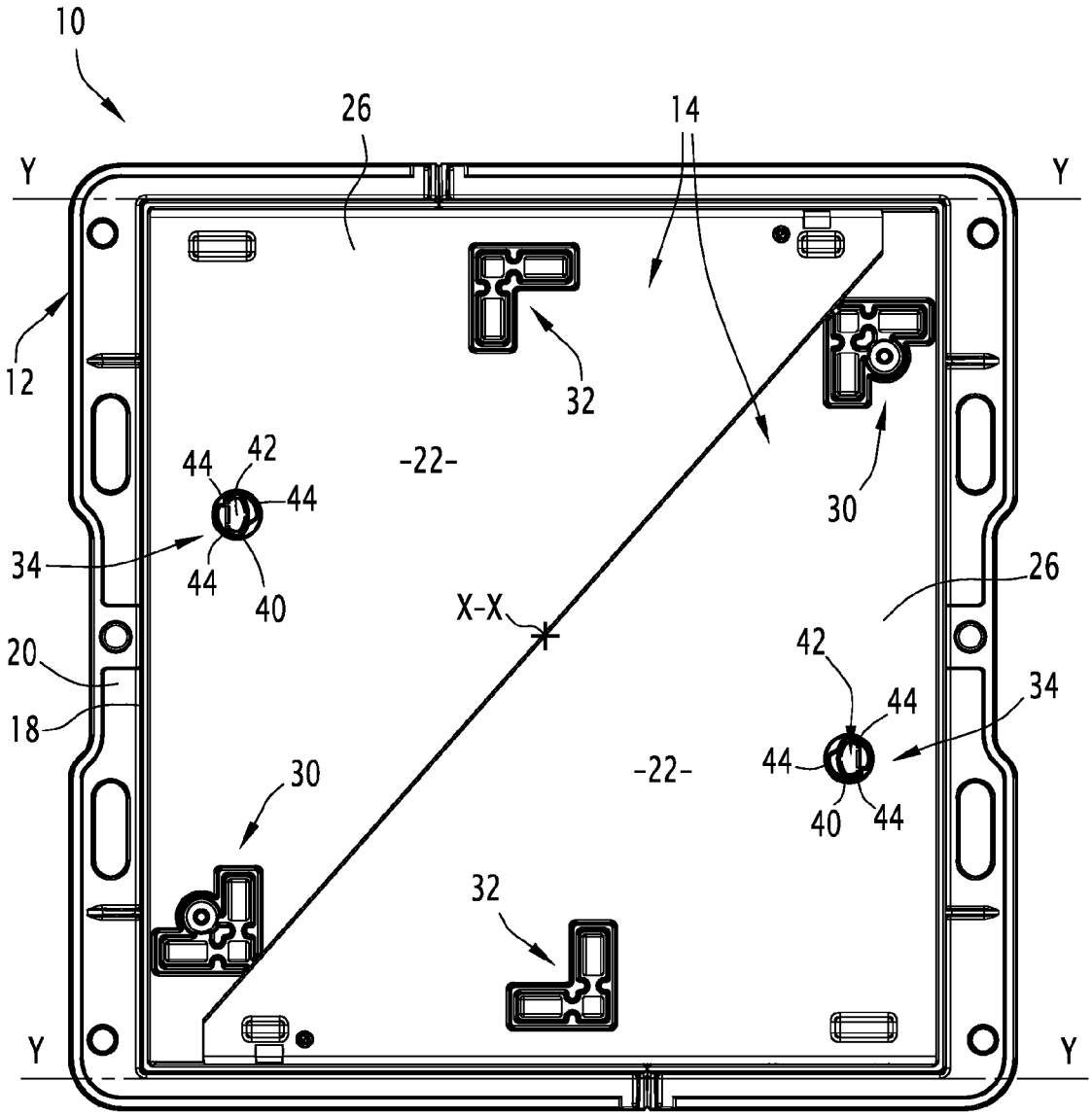
FIG. 1 is a planar view of the outer side of an access cover according to the invention.

The access cover 10 comprises a frame 12 and two covers 14.

The frame 12 is sealed in the ground and delimits an access opening 16 (FIG. 10), for example to an underground room comprising telecommunications cables. In the case at hand, the access opening 16 is square.

The manhole 10 defines a manhole plane P-P that extends substantially parallel to the ground during the installation.

The manhole 10 defines an outer side E and an inner side I. The manhole 10 also delimits a central axis X-X extending perpendicular to the manhole plane P-P. In the following, the expression "peripheral" designates the direction moving radially away from axis X-X and "central" designates the direction coming close to axis X-X.

Furthermore, the manhole 10 includes, for each cover 14, a hinge (not visible) adapted to tilt the cover in question around a hinge pin Y-Y between closed (FIG. 1), intermediate (FIG. 10), 90° open (FIG. 11) and maximally open (FIG. 12) positions.

The frame 12 includes a frame wall 18 extending substantially perpendicular to the manhole plane P-P.

The frame 12 includes a frame base 20 extending parallel to the manhole plane P-P, and protruding radially toward the inside and outside of the frame wall 18. This frame base 20 is intended to be embedded in a sealing material, such as mortar.

Each cover 14 comprises a generic-based body 22 substantially in the shape of a triangle, which covers approximately half of the surface of the access opening 16 and which extends along a cover plane T-T, which is parallel to the plane of FIG. 1.

In the closed position, the cover plane T-T extends parallel to the manhole plane P-P. In the intermediate position, the cover plane T-T extends obliquely relative to the manhole plane P-P, for example at an angle comprised between 30° and 75°. In the 90° open position, the cover plane T-T extends at 90° relative to the manhole plane P-P. In the maximally open position, the cover plane T-T extends at an angle greater than 90° relative to the closed position, for example at an angle comprised between 100° and 110°.

The base body 22 is identical for each cover 14. As a result, a single base body 22 will be described hereafter.

The base body 22 is made in a single piece by molding, preferably from cast iron.

Figure 2:
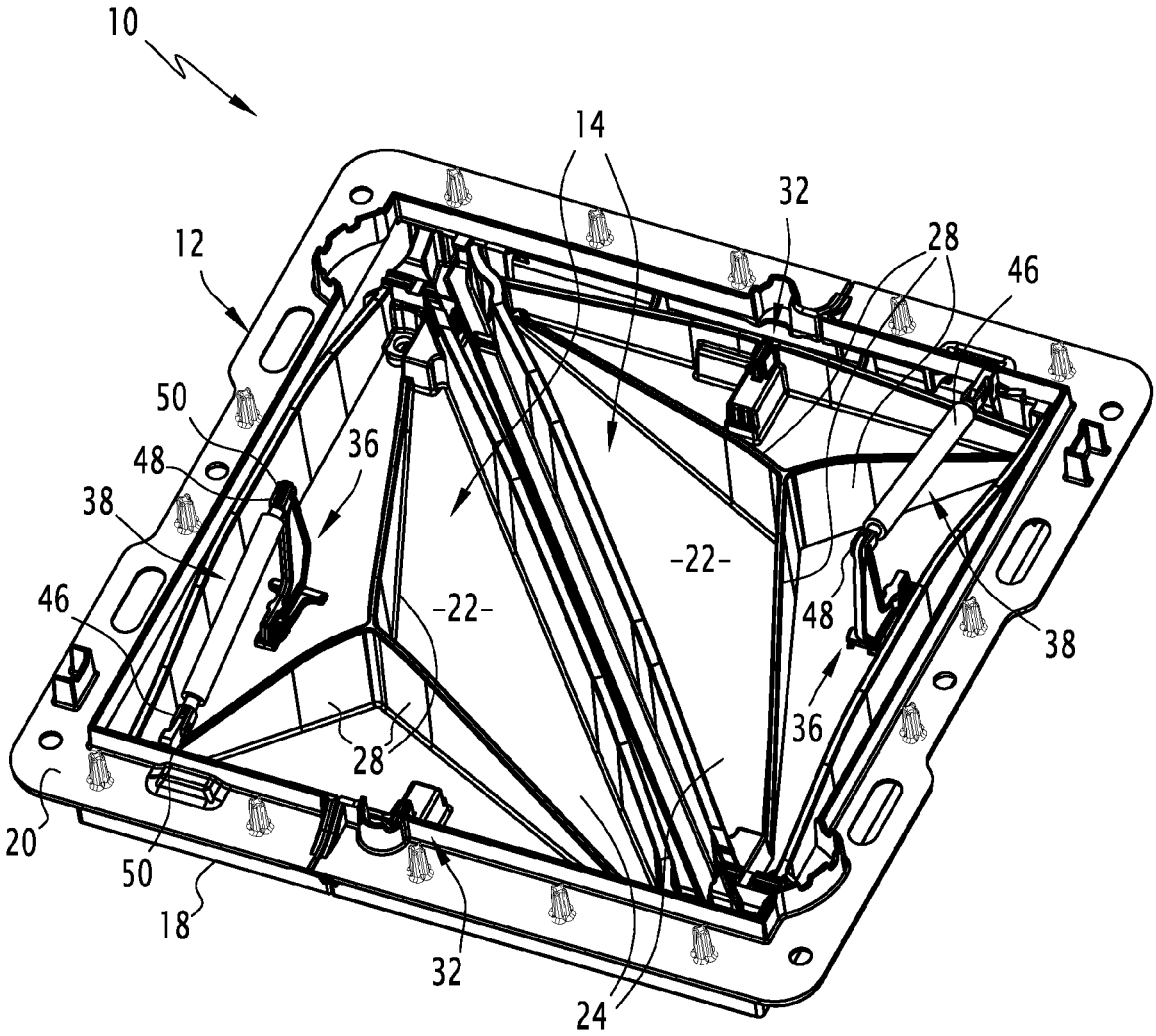
FIG. 2 is a perspective view of the inner side of the access cover of FIG. 1.
Figure 10:
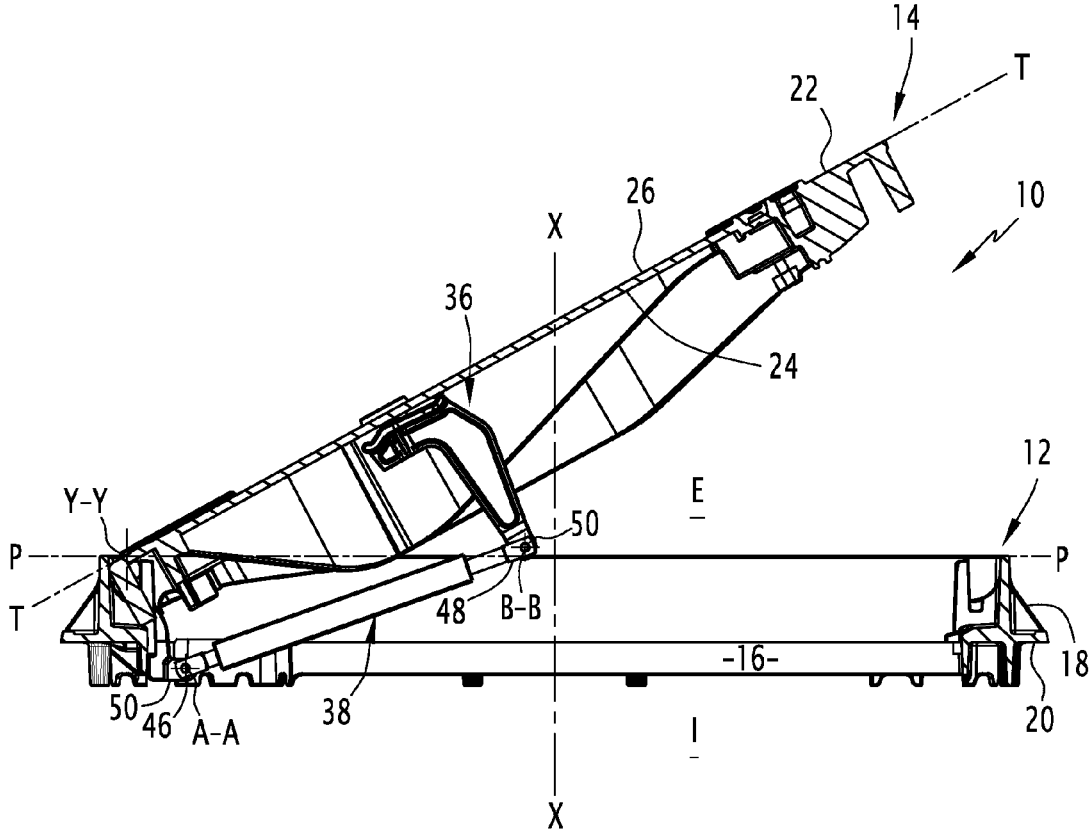
FIG. 10 is a cross-sectional view of the access cover of FIG. 1, the cover being partially raised.

The base body 22 comprises an inner surface 24, visible in FIG. 2, and an outer surface 26 (FIG. 10). The two inner 24 and outer 26 surfaces are parallel to the cover plane T-T. The inner surface 24 corresponds to an inner side of the cover 14, while the outer surface 26 corresponds to an outer side of the cover 14.

The base body 22 is provided with stiffening ribs 28 on the inner surface 24 thereof.

The base body 22 includes a handling zone 30 adapted to receive a handling tool (not shown) intended to maneuver the cover 14 when it is raised by pivoting around the hinge pin Y-Y. This zone 30 is also adapted to lock the cover 14 relative to the frame or to secure the cover 14 relative to the adjacent cover. Furthermore, the base body 22 includes a securing zone 32 adapted to secure the cover 14 relative to the frame 12.

The base body 22 is provided with a receiving zone 34 adapted to receive a fastener 36 of an accessory 38 on the cover 14, as will be explained in more detail hereafter.

The receiving zone 34 is formed by a receiving cavity 40, substantially oblong, formed in the base body 22 and passing through the base body 22. The receiving cavity 40 is a through opening.

During the manufacture of the base body 22, the receiving cavities 40 are not necessarily created. When these receiving cavities 40 are not formed in the base body 22 during the manufacture thereof, each site provided for the receiving cavities 40 is covered by a removable covering portion 42, with a shape substantially identical to that of the cavity 40, which is fastened by at least one frangible portion 44 to the base body 22.

Advantageously, the covering portion 42 and the frangible portion 44 are made in a single piece with the base body 22.

For example, the covering portion 42 is connected to the base body 22 by three frangible portions 44 formed by material bridges.

Thus, when the cover 14 is placed in the frame 12, the covering portions 42 make it possible to limit the penetration, through the receiving cavities 40, of rainwater or miscellaneous waste to the inside I of the manhole 10.

In order to facilitate the tilting of the covers 14 around their hinge pin Y-Y, the access opening 10 comprises, for each cover 14, a jack 38 assisting with lifting the cover 14 and a fastener 36 of the jack 38 on the cover 14. The access cover 10 illustrated in the figures therefore comprises two jacks 38 (FIG. 2).

Each jack 38 is fastened by one of its ends 46 to the frame wall 18 and by its other end 48 to the corresponding fastener 36, using fastening members 50. The fastening member 50 is for example a pin. The end 46 is fastened to the frame wall 18 using a hinge around a hinge pin A-A, while the end 48 is fastened to the fastener 36 using a hinge around a hinge pin B-B.

The hinge pin A-A is parallel to the manhole plane P-P. The hinge pin B-B is parallel to the cover plane T-T. Furthermore, the hinge pins A-A and B-B are parallel to each other, and the hinge pin Y-Y.

The jacks 38 are gas jacks and will therefore not be described in more detail hereafter. Alternatively, the gas jack 38 can be replaced by another thrust element, such as a spring.

Figure 3:
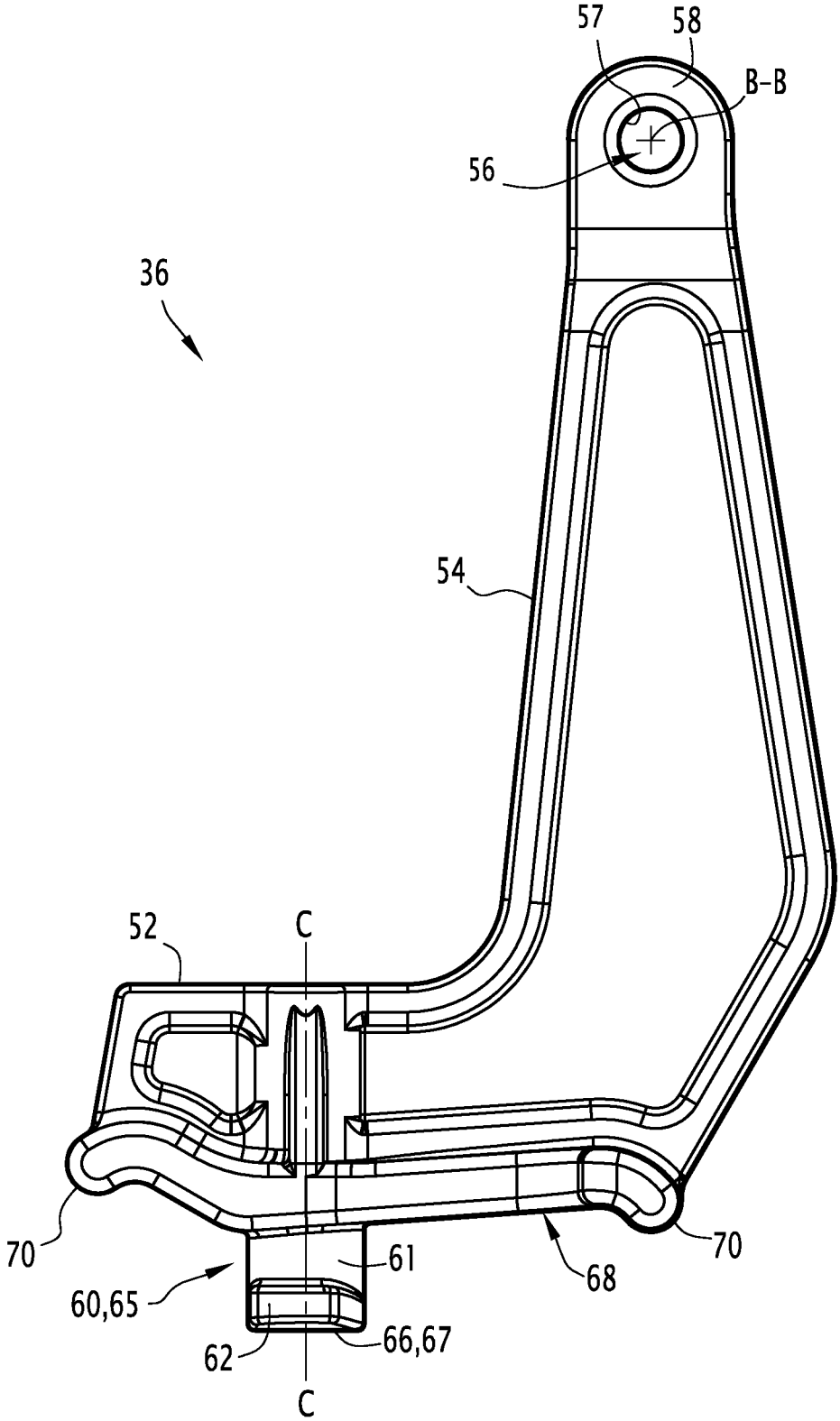
FIG. 3 is a side view of the fastener of the access cover of FIG. 1.
Figure 4:
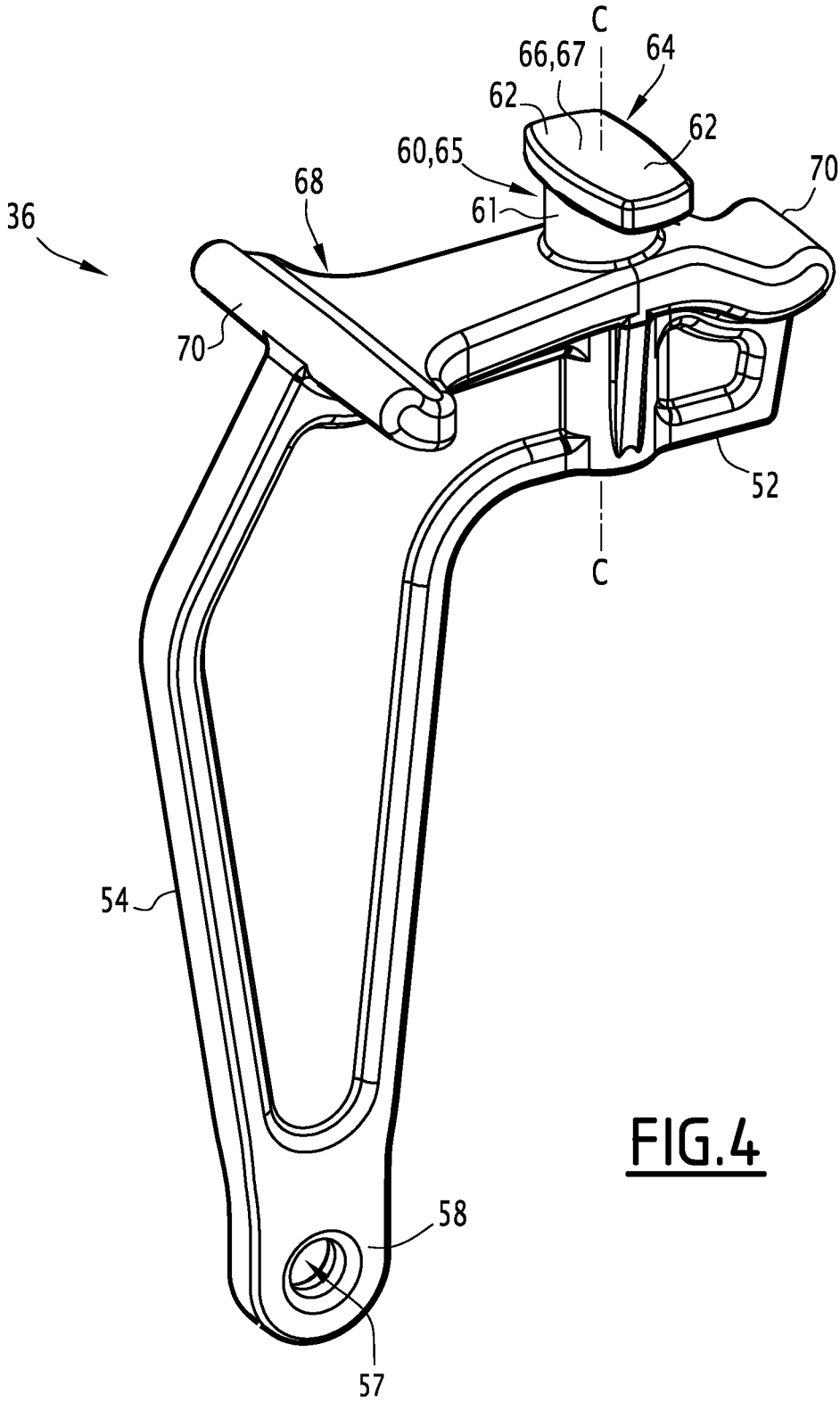
FIG. 4 is a perspective view of the bottom of the fastener of FIG. 3.

As illustrated in FIGS. 3 and 4, each fastener 36 is substantially in the shape of an L with two wings, including a short wing 52 and a long wing 54.

The fastener 36 comprises a fastening or locking means 56 here formed by a fastening opening 57 formed in the long wing 54, close to a free end 58 of the long wing.

The fastening opening 57 is adapted to receive one of the fastening members 50 to fasten the jack 38 on the cover 14.

The fastener 36 is provided with a retaining foot 60 adapted to removably connect the fastener 36 to the cover 14 through the receiving cavity 40 by a shape-matching connection. The retaining foot 60 extends along a foot axis C-C.

The retaining foot 60 has a cylindrical base 61 with axis C-C.

The retaining foot 60 is fastened on the short wing 52 and includes at least one fastening arm 62 adapted to cooperate by shape matching with the cover 14. Here, the retaining foot 60 includes two arms 62 each extending substantially perpendicular relative to the base 61 of the retaining foot 60, and in the extension of one another to form only one single piece 64.

The two arms 62 are positioned on the end of the base 61 opposite the short wing 52.

The piece 64 has a shape substantially identical to that of the receiving cavity 40 and the fastening between the fastener 36 and the cover 14 is of the bayonet type.

The fastener 36 and the cover 14 can thus adopt a retaining configuration, in which the fastener 36 is engaged in the receiving cavity 40 and retained therein by the retaining foot 60, and a release configuration, in which the retaining foot 60 of the fastener 36 can be removed from the receiving cavity 40 or inserted therein.

In the retaining configuration, the fastening arms 62 are angularly offset relative to the receiving recess 40 around the foot axis C-C and overlapping the base body 22.

In the release configuration, the fastening arms 62 are aligned with the receiving cavity 40. Thus, the retaining foot 60 can be inserted into the receiving cavity 40 and removed therefrom by movement along the foot axis C-C.

During this movement, the foot axis C-C is substantially perpendicular to the cover plane T-T.

The fastener 36 includes a punch 65 adapted to form the receiving cavity 40 in the base body 22 of the cover 14.

The punch has a striking surface 67 with a shape substantially identical to the shape of the covering portion 42.

In the example described here, the punch 65 is formed by the retaining foot 60, the striking surface 67 being formed by the outer surface 66 of the piece 64.

In the retaining configuration of the fastener 36, the fastener 36 is adapted to oscillate relative to the cover 14 between two stop positions.

To that end, the fastener 36 comprises a fastening base 68 secured to the retaining foot 60 and extending substantially perpendicularly relative to the retaining foot 60.

The fastening base 68 has an elongate shape and is positioned between the short wing 52 and the retaining foot 60.

The fastening base 68 has two opposite stops 70 each adapted to come into contact with the cover 14 in one of the stop positions.

The fastener 36 has an oscillating freedom substantially comprised between 5° and 15°. The oscillating freedom is a freedom around an oscillation axis extending parallel to the hinge pin Y-Y.

The fastener 36 is made in a single piece and manufactured from metal, in particular cast iron.

The method for fastening the jack 38 on the cover 14 is explained below.

A first step of this method consists of forming the receiving cavity 40.

Figure 5:
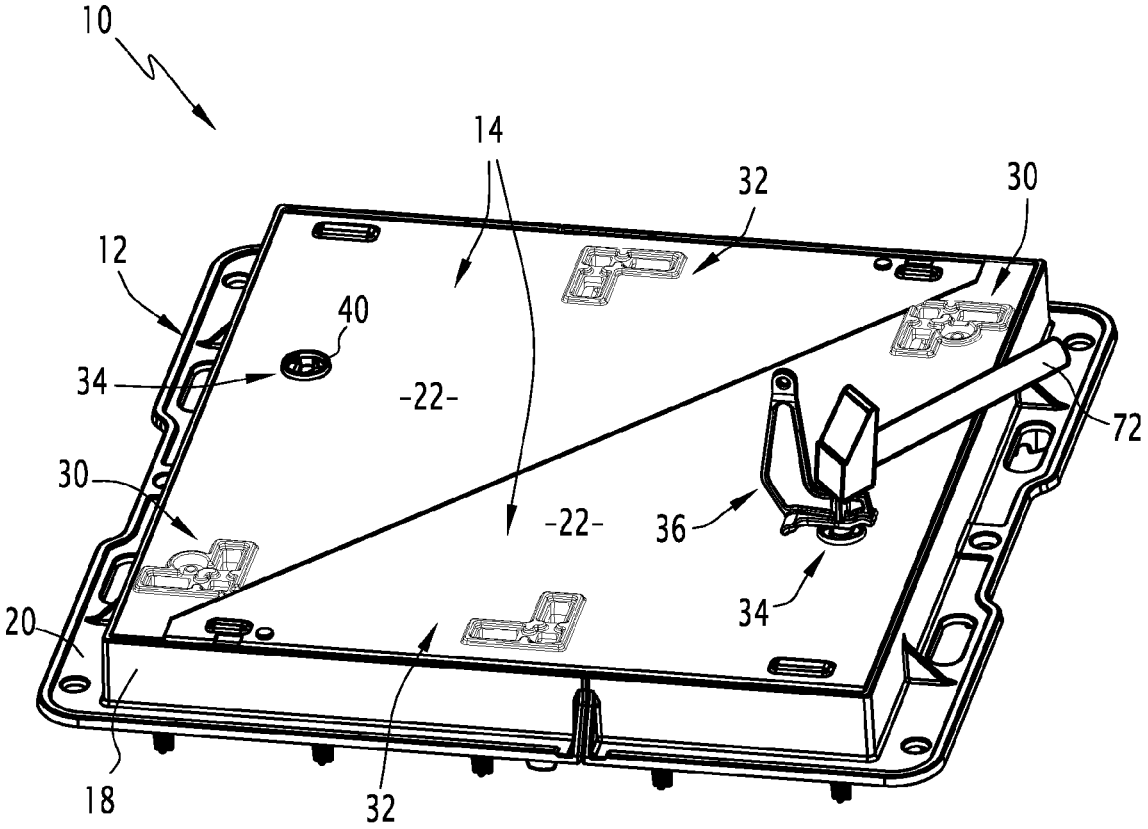
FIG. 5 is a perspective view of the outer side of the access cover of FIG. 1 illustrating a first step of the placement of the fastener on a cover.

To that end, the fastener 36 is placed on the cover 14 by superimposing the striking surface 67 of the punch 65 with the covering portion 42 (FIG. 5).

This may be done when the cover 14 is in its closed position. Furthermore, the striking surface 67 is advantageously placed on the outer side of the covering portion 42.

Using a tool, for example a hammer 72, the user strikes the short wing 52 of the fastener 36 so as to break the frangible portions 44 and thereby free the receiving cavities 40.

Figure 6:
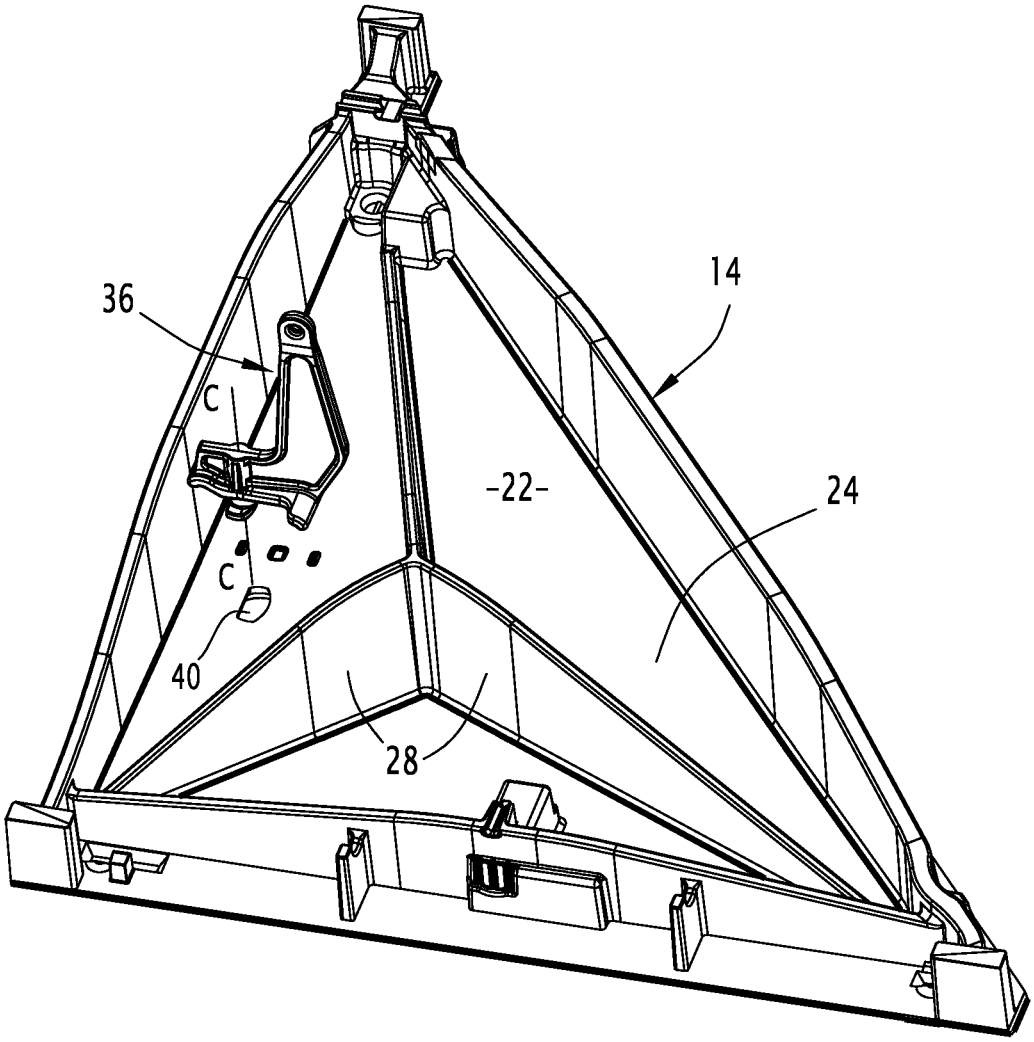
FIGS. 6, 7 and 8 are perspective views of an inner side of a portion of the access cover of FIG. 1 respectively illustrating a second, third and fourth step of the placement of the fastener on the cover.

During a second step of the method (FIG. 6), the arms 62 are aligned with the cavity 40 and the retaining foot 60 is inserted in the receiving cavity 40, on the inner side of the cover 14. This insertion is done along the foot axis C-C and perpendicular to the cover plane T-T.

Once inserted, the arms 62 are located on the outer side of the cover 14.

The cover 14 and the fastener 36 are then in the release configuration.

In this configuration, the short wing 52 extends parallel to the hinge pin Y-Y.

Figure 7:
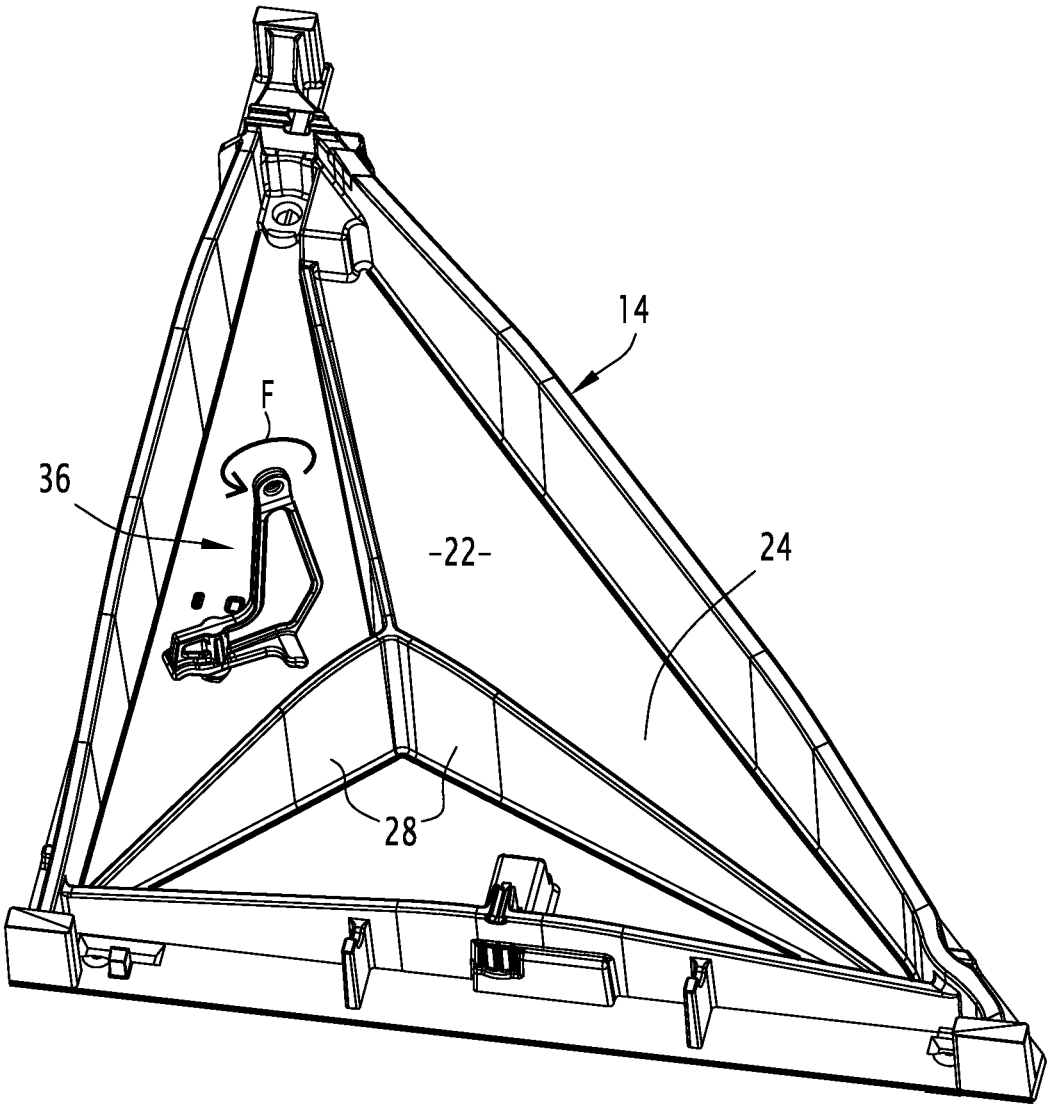
Figure 8:
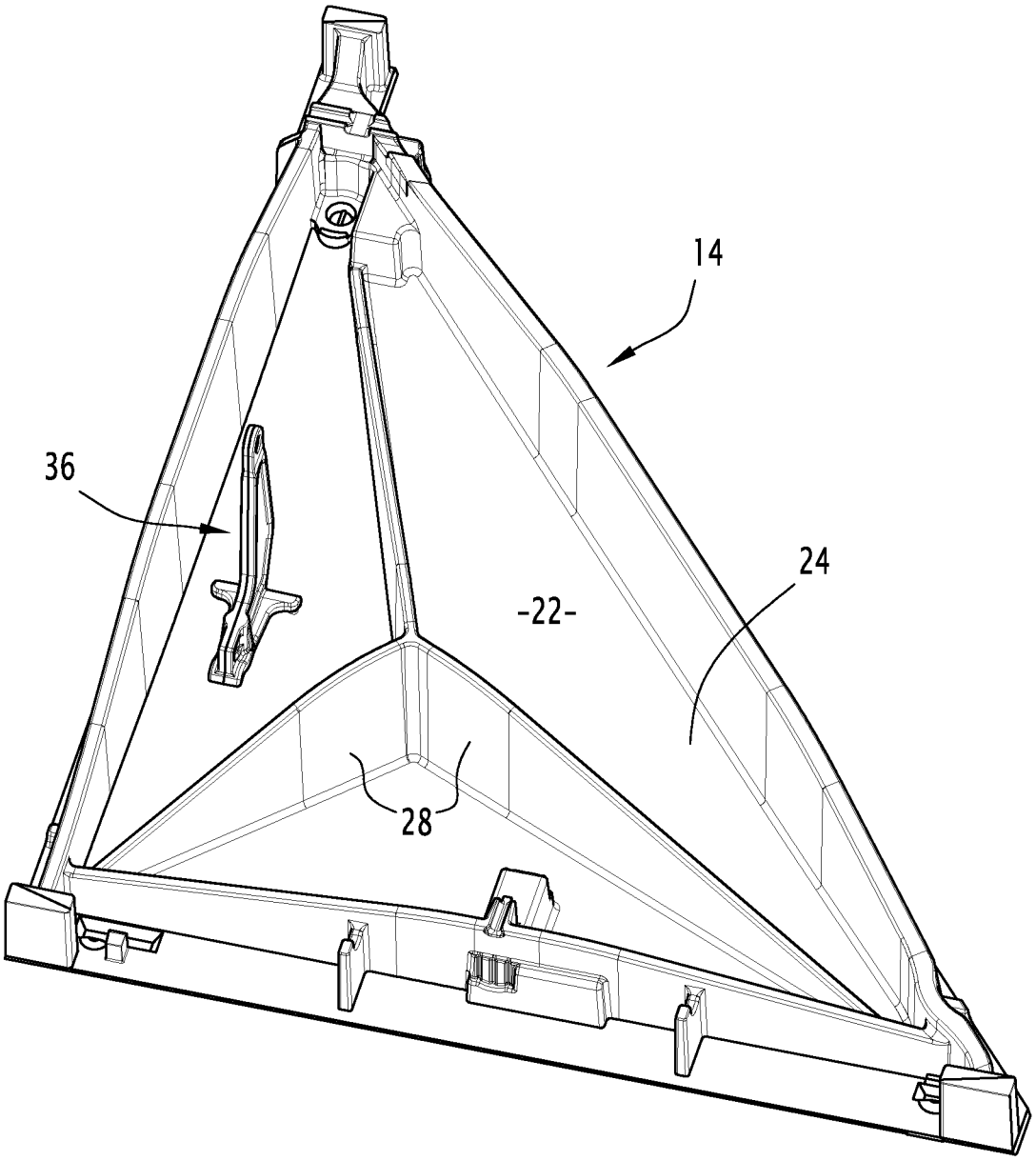

Then, as shown in FIG. 7, the fastener 36 is turned in the direction of arrow F (counterclockwise direction in FIG. 7) around the foot axis C-C and until the short wing 52 of the fastener 36 is oriented toward the associated hinge pin Y-Y and extends perpendicular to that hinge pin (FIG. 8). In that position, the fastener 36 and the cover 14 are in their retaining configuration.

It then suffices for the user to fasten the jack 38 to the fastener 36 using the fastening member 50 and the fastening means 56. The tilting freedom of the fastener 36 around the oscillation axis makes it easy to align the fastening means 56 and the end of the jack.

Figure 9:
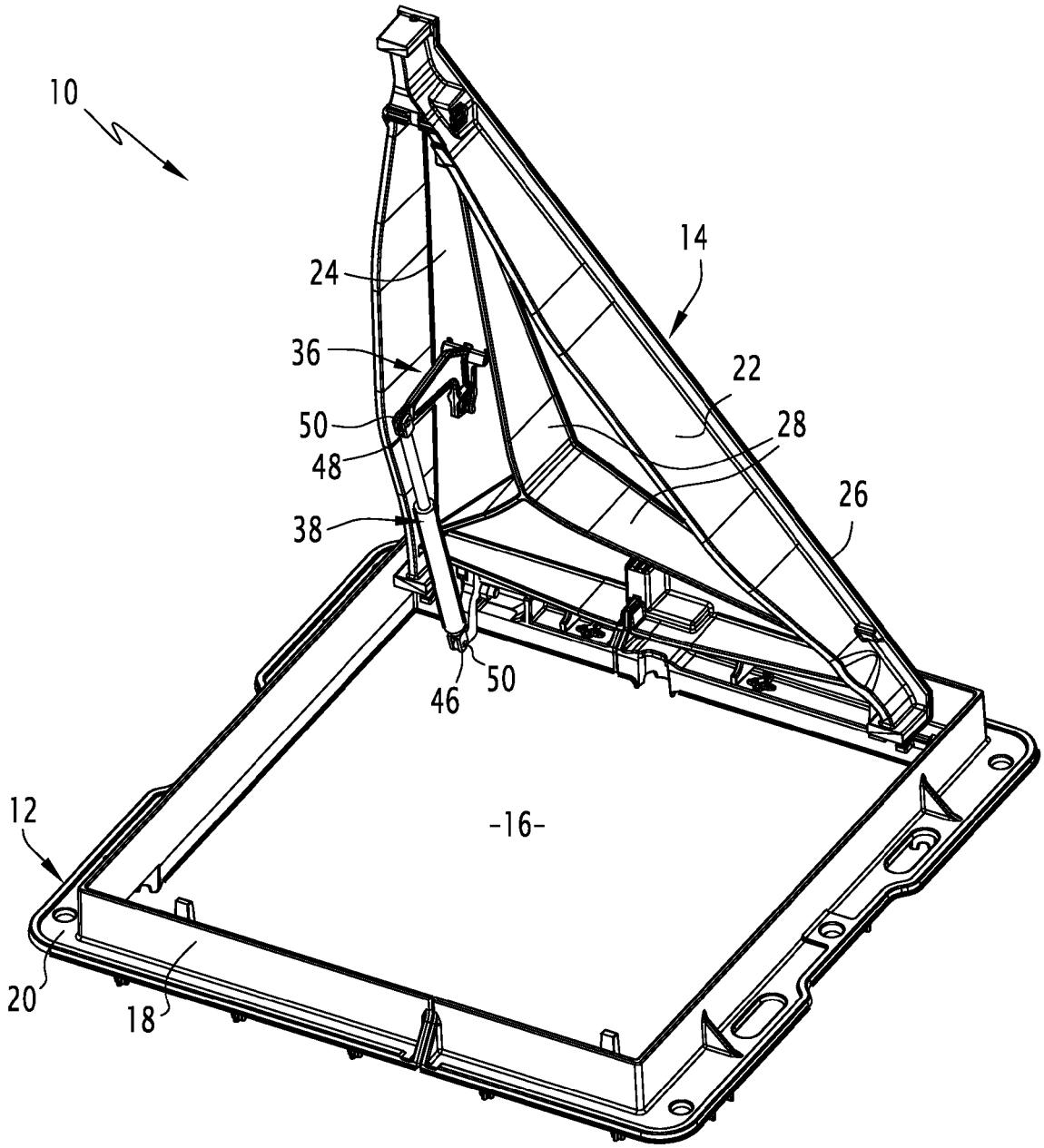
FIG. 9 is a perspective view of the outer side of a portion of the access cover of FIG. 1 provided with a jack.

The jack 38 is thus fastened to the cover 14 (FIG. 9) and then prevents the fastener 36 from pivoting around the axis C-C in the direction bringing the fastener 36 into the release configuration.

Figure 11:
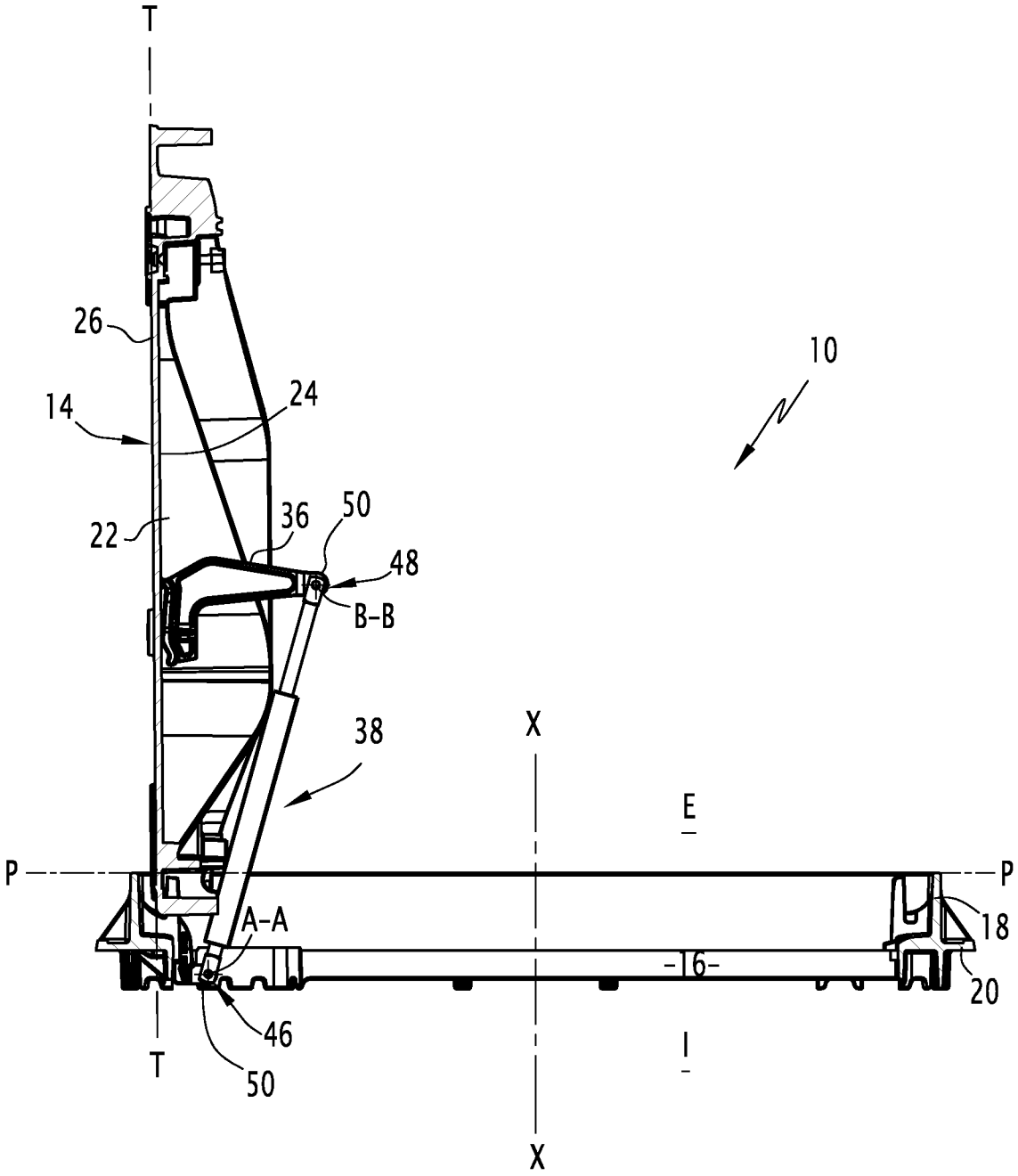
FIG. 11 is a view identical to that of FIG. 10, the cover being in a position 90° open.
Figure 12:
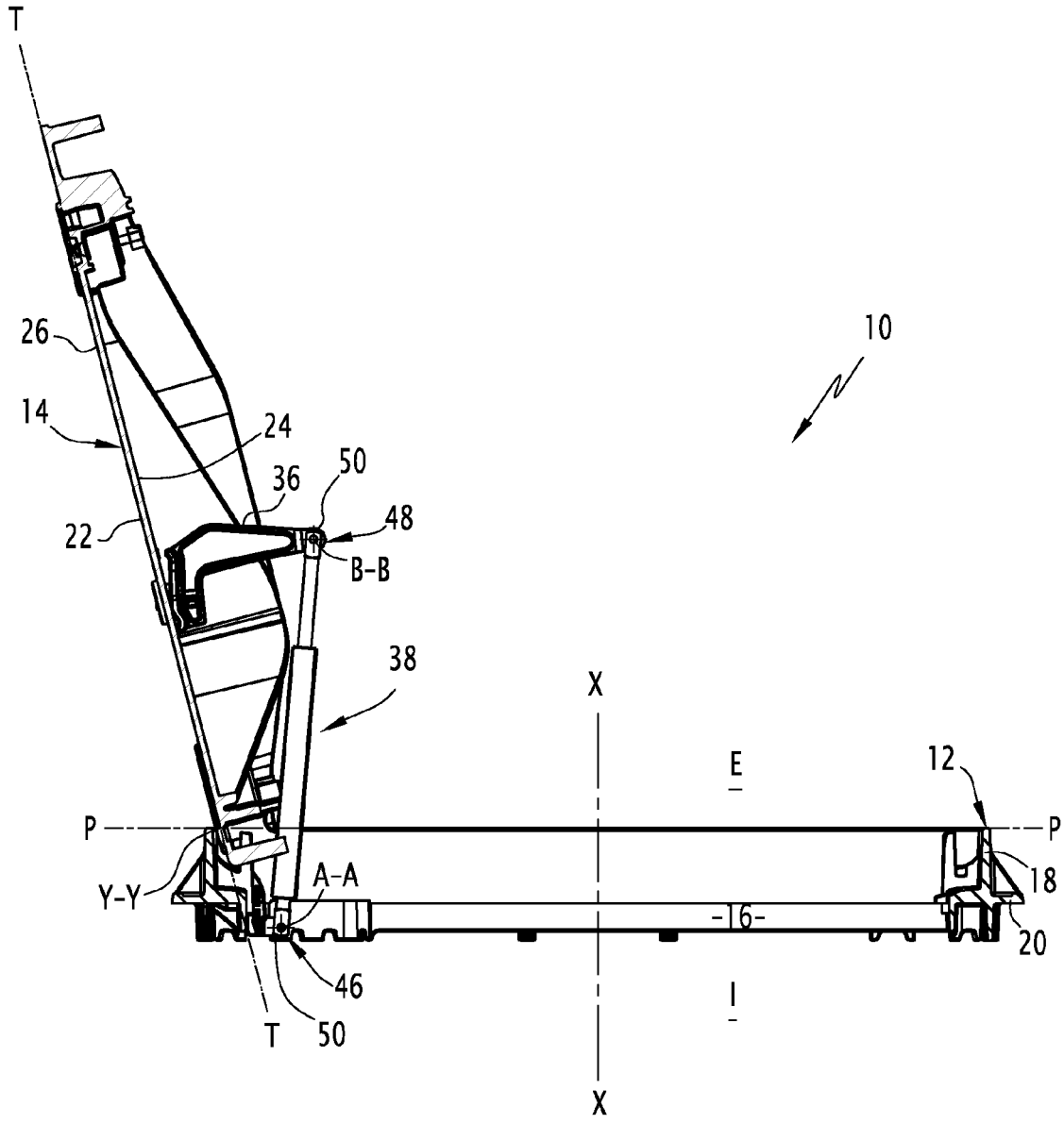
FIG. 12 shows the cover in a maximum opening position.
Figure 13:
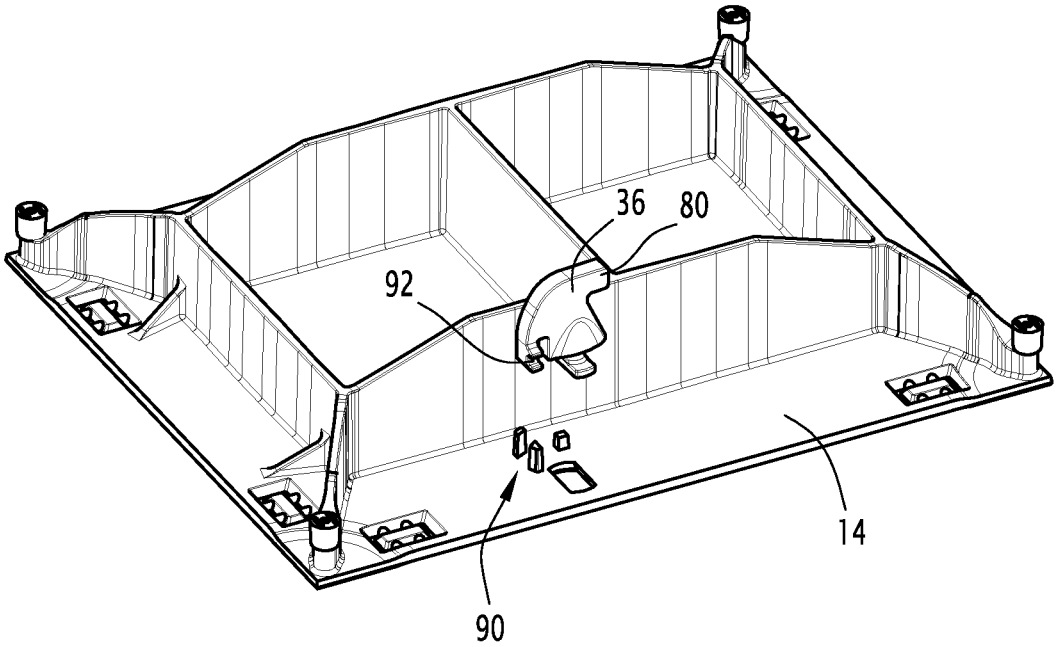
FIGS. 13 to 16 show a perspective view of a second embodiment of an assembly according to the invention, made up of a cover and a fastener in different assembly steps.
Figure 14:
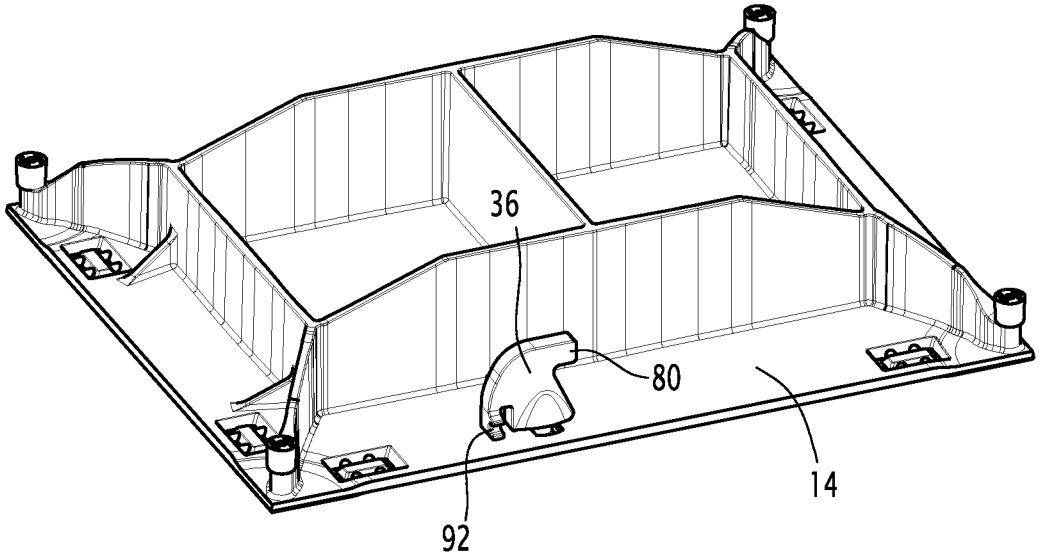
Figure 15:
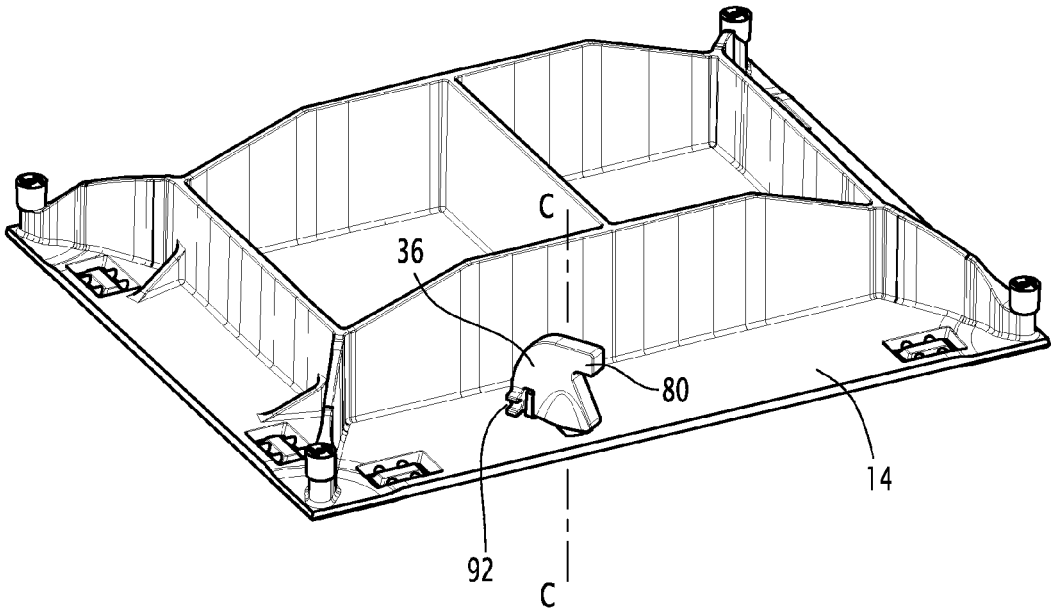
Figure 16:
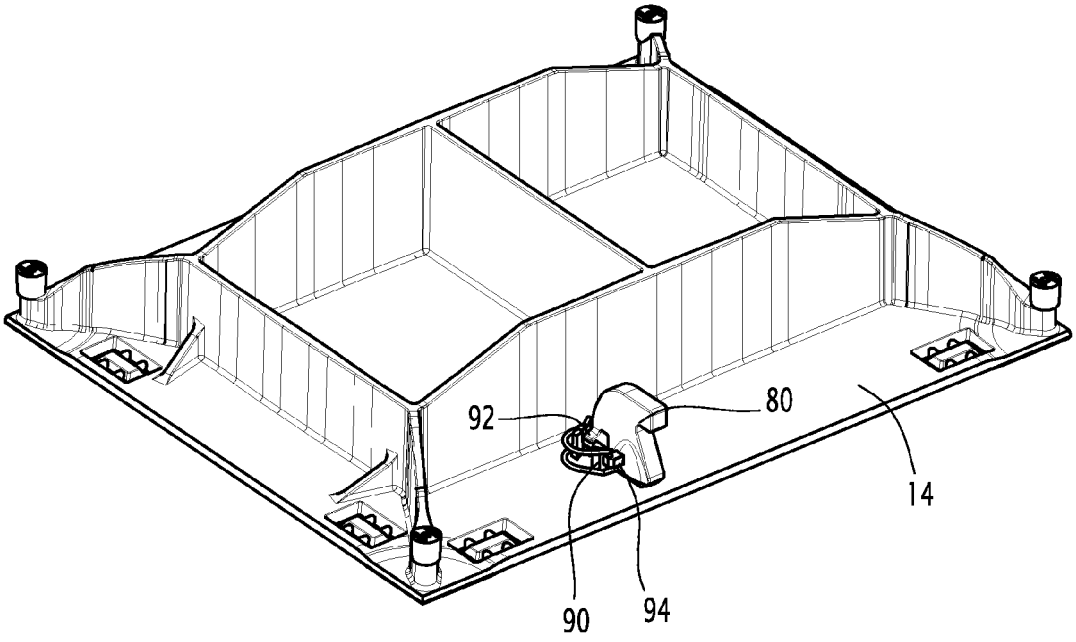
Figure 17:
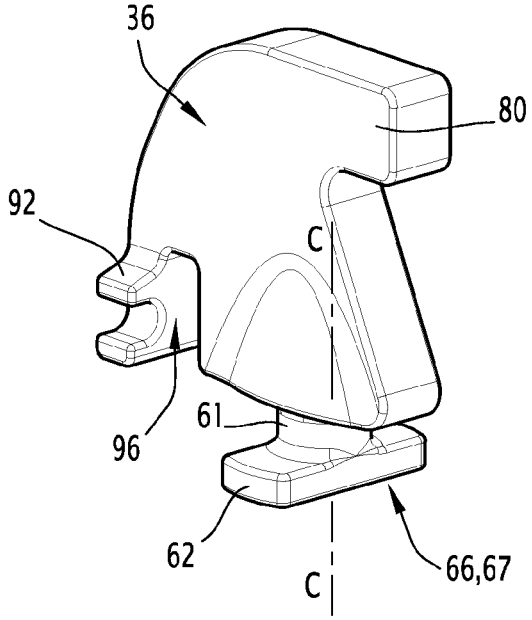
FIG. 17 shows the fastener of FIGS. 13 to 16 on a larger scale.

In reference to FIGS. 10 to 12, during the tilting of the cover 14, the fastener 36 is in one or the other of its stop positions, as a function of the travel of the jack 38.

In particular, between the closed position and the 90° open position, the jack 38 pushes the fastener 36 in one of the stop positions. Beyond 90°, the jack 38 no longer pushes, but owing to its oscillating freedom, the fastener 36 tilts toward the other stop position, thereby allowing the cover 14 to reach the maximum opening position. Between the 90° open position and the maximum open position of the cover, the jack 38 is therefore in a released configuration.

The invention therefore proposes a fastener that is simple and cost-efficient to produce, which facilitates the fastening of an accessory on a street ironwork.

The free oscillation of the fastener 36 allows an easy, fast, effortless and risk-free assembly of the jack.

Furthermore, this oscillating freedom also makes it possible to limit the stresses exerted on the jack 38, in particular at the end of travel, which increases the reliability and lifetime of the jack 38.

Moreover, the choice left to the user to assemble or not assemble the jack not only allows the manufacturer to produce standard covers, but also to package, store and transport them more easily by stacking them.

Consequently, the jack 38, when it is connected to the fastener 36 and the frame, opposes a rotation of the fastener from its retaining configuration to its release configuration. The jack is therefore a means for stopping the rotation of the fastener 36.

The features of the invention were described in reference to an access cover and a fastener for fastening a jack.

The invention also applies to the connection of other fasteners to a member of a street ironwork.

Alternatively, the fastener is a securing fastener having a locking projection. This alternative is shown in FIGS. 13 to 18. The differences relative to FIGS. 1 to 12 are described below.

FIGS. 13 to 16 show various steps of the placement of a fastener 36 on a cover 14, by shape matching of the retaining foot of the fastener with the receiving cavity formed in the cover 14.

Figure 18:
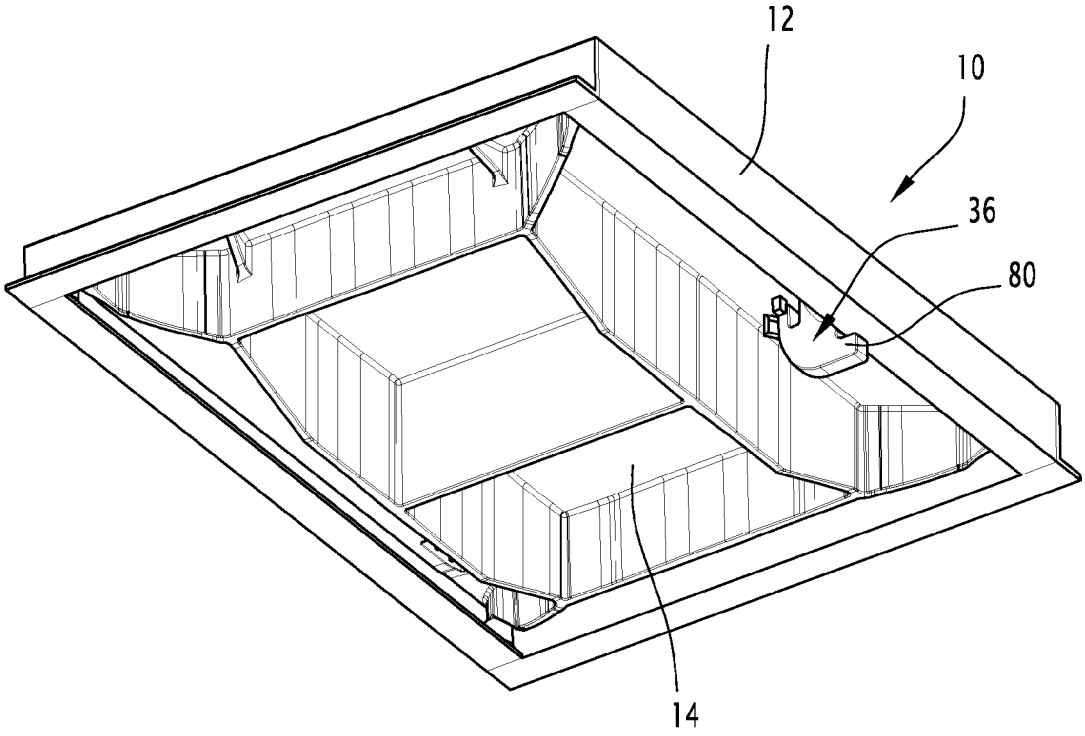
FIG. 18 is a perspective view of the inner side of an access cover provided with a fastener according to FIGS. 13 to 17, the fastener locking the lifting of the cover relative to the frame.

The fastener 36 is also adapted to block the lifting of the cover 14 relative to a frame (FIG. 18).

To that end, the fastener 36 comprises a blocking projection 80 as fastening means 56 to the frame. The blocking projection 80 is adapted to abut against the frame during an attempt to lift the cover.

Furthermore, in its retaining configuration, the fastener 36 is fastened to the cover, without tilting freedom relative to the cover 14.

The assembly also comprises stop means adapted to oppose the rotation of the fastener 36 outside its retaining configuration. The stop means include at least one lug 90 fastened to the cover, a protrusion 92 fastened to the fastener 36 and provided with a groove for receiving a pin 94 (cf. FIG. 16). In the stop position, the pin 94 is positioned between the lug 90 and the protrusion 92 and extends along a pin axis that is parallel to the blocking projection 80. Furthermore, the fastener 36 comprises a passage cavity 96 adapted to allow the passage of the lug 90 fastened to the cover during the rotation of the fastener 36 from its release position to its retaining position.

In an alternative that is not illustrated, the fastener can be a fastener adapted to fasten an anti-vandalism blocking bar.

The jack can also be replaced by another thrust element, such as a spring, for example.

The invention claimed is:

1. A street ironwork, comprising:

a frame (12) defining an access opening (16); and an assembly made up of i) a cover (14) adapted to cover the access opening (16) and extending in a cover plane (T-T), and ii) a fastener (36), the fastener (36) comprising i) a fastening means (56) and ii) a retaining foot (60) suitable for removably connecting the fastener (36) to the cover (14) via a receiving cavity (40) made in the cover (14) by a shape-matching connection, the assembly defining a retaining configuration in which the fastener (36) is engaged in the receiving cavity (40) and retained therein and a release configuration in which the fastener (36) can be removed from the receiving cavity (40), and the retaining foot (60) comprising at least one fastening arm (62), adapted to cooperate by shape-matching connection with the cover (14), the retaining foot insertable into the receiving cavity (40) and removable therefrom on the inner side of the cover (14) through a movement along a foot axis (C-C) that is substantially perpendicular to the cover plane (T-T).

2. The street ironwork according to claim 1, wherein the fastener (36) includes a punch (65) adapted to form the receiving cavity (40) in the cover (14), the punch (65) being formed by the retaining foot (60).

3. The street ironwork according to claim 1, wherein the fastener (36) is made in a single piece.

4. The street ironwork according to claim 1, wherein the fastener (36) is substantially in the shape of an L with two wings (52, 54), the retaining foot (60) being fastened on one of the wings (52), the fastening means (56) being positioned on the other of the wings (54).

5. The street ironwork according to claim 1, wherein the fastener (36) is made from metal.

6. The street ironwork according to claim 1, wherein, in the retaining configuration, the fastener (36) is adapted to oscillate relative to the cover (14) between two stop positions.

7. The street ironwork according to claim 6, wherein the fastener (36) comprises a fastening base (68) secured to the retaining foot (60) and extending substantially perpendicular relative to the retaining foot (60), the base (68) having two opposite stops (70) each adapted to come into contact with the cover (14) in one of the stop positions.

8. The street ironwork according to claim 6, wherein the fastener (36) has an oscillating freedom between the two stop positions comprised substantially between 5° and 15°.

9. The street ironwork according to claim 1, wherein, in the retaining configuration, the fastener (36) is fastened to the cover (14) without a possibility of oscillation.

10. The street ironwork according to claim 2, wherein the cover (14) includes a removable covering portion (42), covering the receiving cavity (40), and fastened by at least one frangible portion (44) to the cover (14).

11. The street ironwork according to claim 10, wherein the punch (65) includes a striking surface (67) whereof the shape is substantially identical to the shape of the covering portion (42).

12. The street ironwork according to claim 10, wherein the covering portion (42) and the frangible portion (44) are made in a single piece with the cover (14).

13. The street ironwork according to claim 1, wherein the fastening means (56) is a retaining projection (80) adapted to abut against the frame (12).

14. The street ironwork according to claim 1, wherein the assembly comprises a stop means (90, 92, 94) adapted to prevent movement of the fastener outside a retaining configuration.

15. The street ironwork according to claim 14, wherein the stop means comprises a pin (94).

16. The street ironwork according to claim 1, further comprising a thrust member that assists in lifting the cover (14), the thrust member being adapted to be fastened by one end (46) to the frame (12), the fastener (36) being connected to the cover (14) using the cavity (40) and the thrust member being fastened by another end (48) to the fastening means (56).

17. The street ironwork according to claim 16, wherein the cover (14) defines a release position relative to the frame (12) in which the thrust member is in a released configuration, in particular the release position is situated between a position 90° open and a maximum opening position of the cover relative to the frame.

18. The street ironwork according to claim 7, wherein the fastener (36) has an oscillating freedom between the two stop positions comprised substantially between 5° and 15°, and further comprising:

an accessory (38) fastened to said cover by said fastening means, wherein, with the retaining foot (60) placed on the cover (14) and pushed in on the cover (14) to form the receiving cavity (40), the fastener (36) is retained on the cover (14) with the retaining foot (60) inserted through the cavity (40) and rotated, and the fastening means (56) fastens the accessory (38) to the cover (14), the accessory (38) being a thrust element that assists with lifting the cover (14).

19. The street ironwork of claim 1, further comprising an accessory (38) fastened to said cover (14) by said fastening means, the accessory (38) being a thrust element that assists with lifting the cover (14).

20. The street ironwork of claim 19, wherein the accessory (38) fastens on the street ironwork by:

the retaining foot (60) being placed on the cover (40);

the retaining foot (60) being pushed in, using a tool, on the cover (14) so as to form the receiving cavity (40);

the retaining foot (60) inserted through the cavity (40) and rotated so as to retain the fastener (36) on the cover (14); and the fastening means fastening the accessory to said cover (14).

21. The street ironwork of claim 1, wherein the fastening between the fastener (3) and the cover (14) is of a bayonet fastening.

* * * * *

UNITED STATES PATENT AND TRADEMARK OFFICE

CERTIFICATE OF CORRECTION

PATENT NO. : 8,591,138 B2
APPLICATION NO. : 13/496205
DATED : November 26, 2013
INVENTOR(S) : Royer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 43 days.

Signed and Sealed this
Twenty-second Day of September, 2015

Michelle K. Lee

Michelle K. Lee
*Director of the United States Patent and Trademark Office*